United States Patent [19]

Comitz

[11] Patent Number: 4,746,124

[45] Date of Patent: May 24, 1988

[54] GOLF PUTTER

[76] Inventor: Edward V. Comitz, 4602 E. La Cienega, Tucson, Ariz. 85712

[21] Appl. No.: 854,029

[22] Filed: Apr. 21, 1986

[51] Int. Cl.[4] ..... A63B 69/36; A63B 53/04

[52] U.S. Cl. ..... 273/164; 273/183 D; 273/169; 273/78

[58] Field of Search ..... 273/183 D, 164, 168, 273/78, 169, 170, 171, 172, 167 F, 167 G, 167 K; D21/217, 218, 219

[56] References Cited

U.S. PATENT DOCUMENTS

| | | | |
|---|---|---|---|
| D. 219,788 | 1/1971 | Leone | D21/218 |
| 786,268 | 4/1905 | Corey et al. | 273/164 |
| 1,653,428 | 12/1927 | Brinkman | 273/80.2 |
| 1,854,548 | 4/1932 | Hunt | 273/78 |
| 2,771,678 | 11/1956 | Hansen | 273/183 D |
| 3,876,211 | 4/1975 | Caligiuri | 273/183 D |

*Primary Examiner*—George J. Marlo
*Attorney, Agent, or Firm*—J. Michael McClanahan

[57] ABSTRACT

An improvement to a golf club putter for aligning the putter head to the golf ball consisting of placing measured thickness protrusions consisting of parallel surfaces on both sides of the hosel of the putter head, the thickness of the protrusions such that when the golfer using the club first aligns himself to the cup and then visually sights along the protrusions to the lower edges of the putter faces, and no portion of the lower edges of the putter faces below the protrusions are visible on either side of the protrusions, the face of the putter head is correctly aligned with respect to the golfer in order to correctly strike the ball for a true travel to the cup. Further, by the added weight resulting from the inclusion of the protrusions to the hosel, the sweet spot of the golf club is thereby enlarged which has the effect of enlarging the area of the head whereby a solid hit is achieved. Lastly, the putter head is partially split longitudinally allowing an extra push to be exerted upon the ball by the putter as it leaves the putter when it is struck.

5 Claims, 1 Drawing Sheet

GOLF PUTTER

BACKGROUND OF THE INVENTION

In the game of golf, putting is considered one of the fine arts. Accordingly, each year sees the introduction of numerous new putters all supposedly designed to improve over the already existing hundreds of putters. Each new putter seems to offer a new twist to the state of the art, incorporating various designs into the shape of the putter head, or in the method in which the head is attached to the putter shaft. Putting, being such a fine art, requires utmost concentration to assure that the golf ball is hit straight and solid, and that it should commence rolling, rather than sliding, as soon as possible after being struck by the putter. A sliding ball is not a controlled ball as is a rolling ball.

Putter construction, in accordance with the rules of the U.S. Golf Association, require that the face of the putter, i.e., the portion which strikes the ball, shall not have any degree of concavity and shall be generally smooth. Most, if not all, putter faces are flat. For a well directed strike or hit, the golfer must orient himself so that he faces at a right angle to the direction which he wishes the golf ball to commence its travel after being struck. In a case where it is desired that the ball roll straight into the golf course cup, the golfer's stance would be such that he faces perpendicularly to a line drawn between the golf ball and the cup. That being so, the putter face which is to strike the golf ball should be in line with the direction the golfer is facing, and also perpendicular to the direction which it is desired that the golf ball should commence its travel.

With today's golf putters, the perpendicular angle at which the club is to strike the golf ball to send it on its way is determined by the golfer looking at the face of the putter head and then by rotating the head until the golfer believes that the proper right angle alignment of the putter head with respect to the golf ball has been achieved for the subsequent striking of the golf ball.

In striking the golf ball with the putter head, it is important that that portion of the head known as the "sweet spot" contact the ball. The sweet spot is generally defined as that portion of the putter head where a solid hit is achieved, and is the center of mass of the putter head. According to the November 1984 issue of GOLF MAGAZINE, the "sweet spot" or center of mass may be determined by holding the putter loosely between the thumb and the forefinger in a hanging position and gently tapping the face of the putter with the eraser end of a pencil. The point at which the head resists twisting is the sweet spot.

Obviously then, it becomes a great advantage to the golfer to know if there exists some means by which the golfer may ascertain through a mechanical method that his putter head is in right alignment with his stance, he increases his changes that he will properly strike the golf ball and that the golf ball will commence its travel in the proper direction relative to the golfer. It is also an obvious benefit to the golfer if the golfer can hit the ball in the sweet spot of the putter so, accordingly, if the sweet spot of the putter has been modified such as to enlarge it, more repetitive solid hits of the golf ball can be expected.

It is the object of the subject invention to provide these improvements to the golfer in order to enhance his golf game.

SUMMARY OF THE INVENTION

The embodiment of the invention described consists of placing added metal upon the shaft or "hosel" as it is known, of a golf club putter head in the form of protrusions or projections whereby the golfer, by sighting along the sides of the protrusions or projections on the shaft, can rightly align the golf club putter head in relationship to his stance and be perpendicular to an imaginary line drawn between the cup and the golf ball, or any other direction that it is desired the golf ball travel immediately after being hit. By virtue of the protrusions or projections which are added to the putter hosal, weight is also added with the effect that the sweet spot area at which a solid hit is achieved is enlarged.

To accomplish the above, the inventor forms on the shaft or hosel of the putter head two protrusions on opposite sides directed outwardly of the shaft and having a cross-section which may be round, square, heart-shaped, or the like. The faces of these protrusions are parallel and flat on their cross-sectional surfaces, and are aligned to be parallel with the lower edge of the face of the putter head, i.e., the edge at the bottom of the portion which strikes the golf ball. Since the bottom edges of the putter head are also parallel and symmetrical with respect to the hosel, the face of each protrusion is thus parallel with the bottom edge of the putter face directly below it. The protrusions which emerge from opposite sides of the hosel have a total side to side thickness such that the golfer, when holding the golf club and viewing the putter head, can rightly align the putter head by sighting along the outside surfaces of the protrusions, and when the bottom edges of the face of the putter head and the opposite side are in alignment with the protrusions and are just covered by the protrusions, the putter head is correctly aligned with respect to the golfer's stance. Now if the golfer's stance is such that he faces at right angles to the direction which the golfer intends that the ball should travel, the putter head will also be in correct right angle alignment for striking the golf ball.

The Inventor has chosen to form the protrusions with a cross-sectional shape of an inverted heart for decorative purposes, although any shape, which may be in cross-section round or square or other shape, would also work.

It has been determined that with the addition of the weight of the protrusions added to the putter head hosel, the sweet spot where the putter will most solidly strike the ball is enlarged and drawn somewhat rearward towards the heel of the putter head.

In the preferred embodiment, the Inventor has located the sightline, a notch transversely across the putter head, as the most forward point of the area of the sweet spot.

In addition, it has been determined that an additional push can be given to the struck golf ball by placing a slot lengthwise through the bottom portion of of the putter head to divide longitudinally the head into two partially separated portions. By such means, when the golf ball is struck, the portion of the head divided by the slot which first engages the golf ball, flexes backwards a slight amount, and then springs forward as the golf ball leaves the head and thereby imparts an added push or velocity to the ball.

In an alternate embodiment, the slot directed longitudinally through the putter head is eliminated for those who prefer a more solid single striking of the golf ball.

Accordingly, it is an object of the subject invention to provide means by which correct alignment of the putter head relative to the golfer may be achieved.

It is another object of the subject invention whereby the correct alignment of the putter head to the golfer is provided by the golfer's sighting along the putter head shaft.

It is still further another embodiment of the subject invention to provide means by which the sweet spot of the putter head is enlarged.

It is another object of the subject invention to provide a means whereby the putter head may flex upon hitting of the golf ball and thereby impart an additional push to the ball as it leaves the putter head.

Other objects of the invention will in part be obvious and will in part appear hereinafter. The invention accordingly comprises the apparatus possessing the construction, combination of elements, and arrangement of parts which are exemplified in the following detailed disclosure and the scope of the application of which will be indicated in the claims.

BRIEF DESCRIPTION OF THE DRAWINGS

For further understanding of the features and objects of the subject invention, reference should be had to the following detailed description taken in connection with the accompanying drawings wherein.

In the various views, like index numbers refer to like elements.

DETAILED DESCRIPTION OF THE PREFERRED EMBODIMENT

Figure 1:
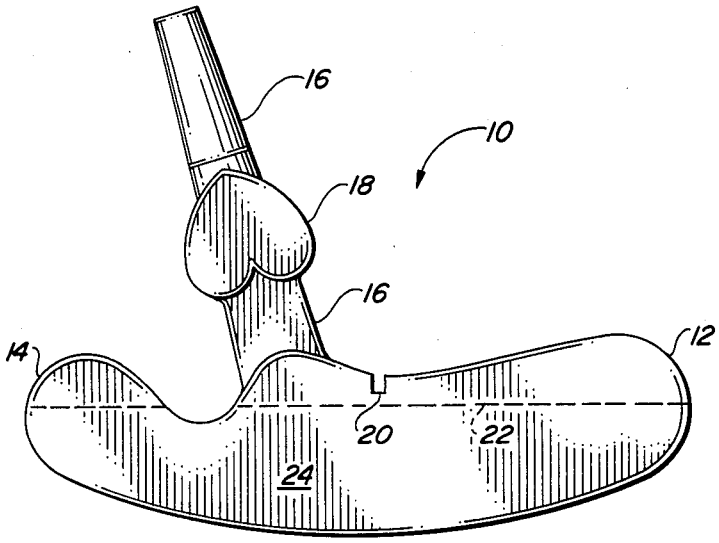
FIG. 1 is a side view of the inventive putter head.

Referring now to FIG. 1, a side view of the inventive putter head 10 is shown. Firstly, the right portion of the head 10 is known as the toe 12 of the putter, and the rear portion known as the heel 14. Located at a point slightly more than half the distance from the toe 12 to the heel 14 is the area where the hosel or shaft 16 joins the head. The hosel 16, which is shown emerging upward from the head, is a solid shaft about which the golf club shaft held by the golfer encompasses in a fixed connection to form a completed golf club. The hosel may also be sleeve shaped, but still adapted to receive the shaft of the golf club to firmly attach the putter head to the golf club.

Figure 4:
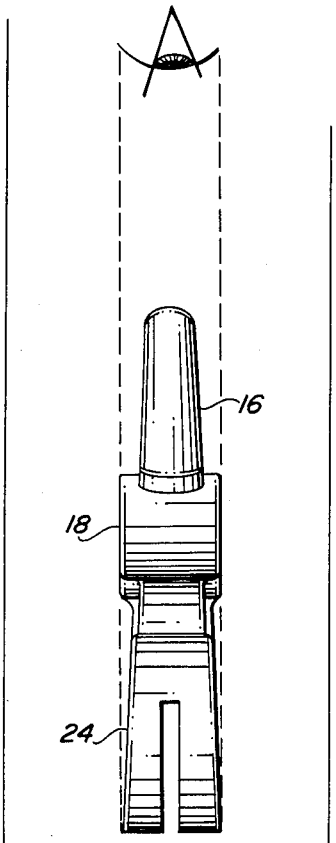
FIG. 4 is a front view of an alternate embodiment of the subject inventive putter head.

Attached to the hosel is an inverted heart-shaped lateral protrusion 18 which emerges equally distant on both sides of the hosel, and has a fixed face to face known thickness. The surfaces of opposite faces of the protrusions are flat, parallel with themselves, and are also parallel with the bottom edges of the sides of the head. The ball striking side of the head is known as the "face", i.e., that portion adapted to strike the golf ball, and the other side known as the "side opposite the face". The face is denominated as numeral 24. As is readily apparent, if the putter head has only one face, then the club may be used by only right handed golfers, or left handed golfers, but not both. Now it is common for the putter head to have both sides finished to form ball hitting faces on both sides so the golf club is adaptable by both right and left handed golfers. Accordingly, the heads shown in FIGS. 2–4 show a head which has ball hitting faces on both sides.

Shown on the putter head, immediately forward of the area where the hosel joins the club head, is notch 20 formed transversely across the head. This notch, known as the "sightline", locates the forward limit of the "sweet spot" area of the club. Shown passing from toe 12 to heel 14 is a dotted line representing groove or slot 22 which, in the preferred embodiment, essentially splits almost all of the putter head 10 into two separate pieces.

Figure 2:
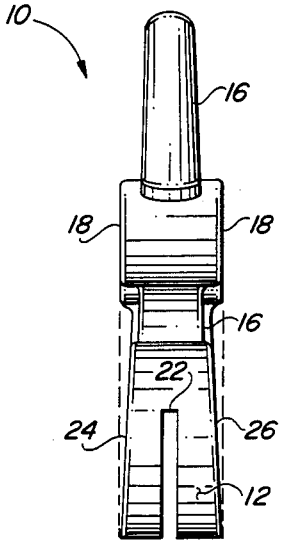
FIG. 2 is a front view of the subject inventive putter head.

Referring now to FIG. 2, a front view of putter head 10 is disclosed. Commencing at the top of FIG. 2, hosel 16 is shown emerging from the main body of head 10, here a solid shaft adapted to be encompassed at its end by a blind hole in the end of the golf club shaft (not shown). Located on hosel 16 is outwardly directed protrusions 18 shown in the front view detailing how the protrusions emerge from both sides of the hosel 16. It is noted that the side to side thickness of protrusions 18 is the same thickness as the distance between the bottom edges of the lowest portion of the body of the head 10, and that the sides of protrusions 18 are parallel to the bottom edges of head 10. Next, toe 12 is seen with slot 22 passing through the total length of putter head 10. It is noted that the face of the putter head, i.e., that portion adapted to strike the ball and designated numeral 24, generally rises from the bottom-most part of the head at an angle of not more than 10° from the vertical. This is known as the "loft" of the face 24. In the subject invention, both sides of putter 10 are alike and therefore either side may serve as the hitting face, thus the putter head is adaptable to both left and right handed golfers. Accordingly, the face opposite face 24 is denoted by numeral 26 and all discussion relative to face 24 is equally applicable to face 26. The face 24 is machined smooth and flat with horizontal grid lines running from toe to heel. In the event that it is desired to restrict the club to either a right handed or left handed golfer solely, then the face opposite the intended hitting face may be left free of machining as desired.

Figure 3:
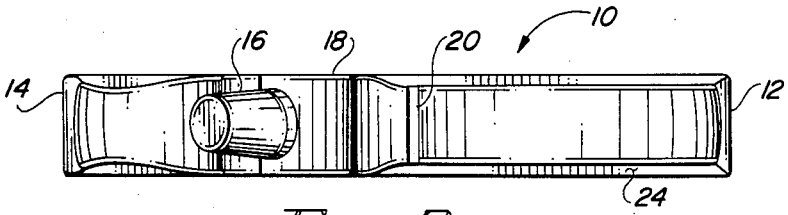
FIG. 3 is a top view of the subject inventive putter head.

Continuing, FIG. 3 shows a top view of the subject putter head 10 disclosing, in order, hosel 16, heart-shaped protrusions 18, notch 20, toe 12, and heel 14. It is noted that opposite sides of the putter are parallel, meaning that the thickness of the toe and heel are the same. The top and bottom edges of face 24 and its opposite side, face 26, may be seen as two pair of two parallel lines.

With the improvements which the Applicant has added to the art of putter construction, it is now possible for the Applicant to visually align the putter head adjacent the golf ball such that the face of the putter head is correctly aligned to an imaginary line drawn between the golf ball and the hole or cup or other direction that the golfer is attempting to direct the golf ball providing the golfer has properly aligned himself with respect to the golf ball and cup, or other direction desired.

Utilizing a putter possessing the inventive putter head described, and assuming that the golf club shaft has been properly applied to the hosel of the subject putter head, the golfer first takes a position with respect to an imaginary line drawn between the cup and the golf ball or other direction the ball is to travel, such that he or she faces perpendicularly to that line, feet apart, and immediately above the golf ball with the golf ball approximately equal distance from each foot. This is the common and usual stance taken by golfers when making the putting shot. With the golf club in a vertical plane, the golfer aligns the putter to the golf ball and cup by positioning the putter head immediately behind the golf ball in such a position that the face of the head is aligned perpendicular to the imaginary line drawn between the cup and the golf ball. This alignment the golfer achieves with the subject putter head by viewing down upon the head as he holds the putter shaft. If the putter head is so aligned that when the golfer sights past both sides of the heart-shaped protrusions on the hosel to the bottom edges of both putter faces in the immediate viewing sector defined by the perimeter lines of the faces of the heart-shaped protrusions, then the golfer knows that the faces of the putter are aligned with respect to his stance. Accordingly, if the golfer's stance is properly aligned with the imaginary line to the cup, then so will be the putter head.

If the face 24 of the putter head is not properly aligned to the golfer and thus to the imaginary line between the cup and the ball, a portion of faces 24 or 26 will be visible immediately adjacent to the edge of the face of the heart-shaped protrusions as viewed from above. The heart-shaped protrusions are so sized and have a thickness so determined that they will shadow portions of both faces, together with their respective edges, from the golfer's view. By such means, the golfer then knows that the face of the putter is in proper alignment with respect to him. In the preferred embodiment, the thickness of the protrusions transversely to the longitudinal direction of the head is the same thickness as the thickness at the bottom of the body of the head. Since the protrusions are slightly closer to the eye of the golfer, it will appear slightly larger and shadow the like thickness of the putter below or behind it.

Once the putter head is properly aligned, the golfer then needs to assure himself that he will be hitting the ball in the club's "sweet spot", which is determined in the subject invention to be that area from the rear limit of the heart-shaped protrusion on the heel portion of the head (as viewed) to the notch or sightline 20. Striking the ball with the putter head aligned, and in the area from the rear portion of the heart-shaped protrusion to the notch, produces a well defined, solid, and consistent hit. The rear limit to the "sweet spot" substantially extends to a point which is immediately vertically below the rear edge of the heart-shaped protrusions. With the addition of the protrusions to the hosel, more weight is placed in the vicinity of the existing "sweet spot" proximate the point where the hosel attaches to the faces of the head and, with the addition of weight in that immediate area, the effect is to enlarge the "sweet spot". An enlargement of the "sweet spot" makes it easier for the golfer to achieve a more solid strike of the ball.

It has been determined that by forming longitudinal slot 22 through the greater portion of the vertical portion of putter head 10, more "spring" is imparted to the golf ball when it is struck by the putter head. This allows the face 24, when striking the golf ball, to firstly yield slightly backwards and then, as it returns to its original place, to urge the golf ball on its way with an extra push.

Continuing on, FIG. 4 discloses an alternate embodiment of the invention wherein in the front view shown, the longitudinal slot 22 of the preferred embodiment has been deleted so that the putter head is a solid, unslotted piece. In this respect then, the putter will act like most putters and does not exhibit the spring back portion of the head as does the preferred embodiment. In all other aspects, however, the putter head shown in FIG. 4 is the same as that shown in the first three Figures, i.e., the heart-shaped protrusions 18 still are designed to enable the golfer to visually ascertain that the club head is rightly aligned to the golfer's stance.

While a preferred embodiment of the device, together with an alternate embodiment has been shown and described, it will be understood that there is no intent to limit the invention by such disclosure, but rather it is intended to cover all modifications and alternate constructions following within the spirit and the scope of the invention as defined in the appended claims.

I claim:

1. An improvement to a golf putter head of the type having a first ball striking face and an opposite side, a toe and a heel at opposite ends of said face, and an elongated hosel having a longitudinal axis, said hosel attached at a point proximate said face, said hosel adapted to be partially surrounded and held by an associated golf club shaft, said face and said opposite side each having parallel bottom edges opposite said point where said hosel attaches with a known thickness between said parallel edges, said face also having a "sweet spot" area for ball impact proximate said hosel, said face additionally angled with respect to the longitudinal axis of the hosel, said improvement adapted to align the ball striking face to the cup and to align the face for striking in the "sweet spot" area, the improvement comprising:

a pair of protrusions formed on said hosel, said protrusions protruding from opposite sides of said hosel, each of said protrusions characterized by a flat face, said flat faces parallel to each other and having a determined thickness between said faces equal to the known thickness between said parallel edges opposite said point where said hosel attaches, said parallel flat faces also parallel to the bottom edges of the ball striking face and the opposite side of the golf putter head, said protrusions increasing the weight of said golf putter head proximate said "sweet spot" to enlarge said "sweet spot area"; and said golf putter head including a centrally located longitudinal slot formed in said head from the toe to the heel, said golf putter head adapted to be aligned for striking the ball to the cup and aligning for striking the ball in the sweet spot area by sighting said protrusions parallel flat faces to said ball striking face and opposite side bottom parallel edges and said longitudinal slot adapted to impart "spring" to said head when striking the ball whereby said golf putter head may be correctly aligned for striking the golf ball and propelling it to the cup and also thereby making it easier for the golfer to hit the golf ball on the sweet spot.

2. The improvement to a golf putter head as defined in claim 1 wherein said head opposite side defines a second ball hitting face, said second ball hitting face opposite and symmetrical to said first ball hitting face relative to said hosel longitudinal axis.

3. The improvement to a golf putter head as defined in claim 1 wherein said parallel faces of said protrusions define in cross-section a heart shaped face.

4. The improvement to a golf putter head as defined in claim 1 wherein said pair of parallel faces of said protrusions define in cross-section a square shaped face.

5. The improvement to a golf putter head as defined in claim 1 wherein said pair of parallel faces of said protrusions define in cross-section a round shaped face.

* * * * *